US006613716B2

(12) United States Patent
Hoefs et al.

(10) Patent No.: US 6,613,716 B2
(45) Date of Patent: Sep. 2, 2003

(54) THERMAL PRINT PAPER AND PROCESS

(75) Inventors: Eugene V. Hoefs, Franklin, OH (US); Regina A. Kleinhenz, Trotwood, OH (US)

(73) Assignee: Miami Wabash Paper LLC, Norwalk, CT (US)

( * ) Notice: Subject to any disclaimer, the term of this patent is extended or adjusted under 35 U.S.C. 154(b) by 1 day.

(21) Appl. No.: 09/819,572

(22) Filed: Mar. 28, 2001

(65) Prior Publication Data

US 2002/0183203 A1 Dec. 5, 2002

Related U.S. Application Data

(60) Provisional application No. 60/268,425, filed on Feb. 13, 2001.

(51) Int. Cl.[7] ..... B41M 5/30

(52) U.S. Cl. ..... 503/217; 503/209; 503/220

(58) Field of Search ..... 106/31.17, 31.18, 106/31.19, 31.2, 31.21; 503/209, 216, 217, 220

(56) References Cited

U.S. PATENT DOCUMENTS 5,942,464 A * 8/1999 Vaughn et al. ..... 503/200

* cited by examiner

*Primary Examiner*—B. Hamilton Hess
(74) *Attorney, Agent, or Firm*—James R. Frederick; Ware, Fressola, Van Der Sluys & Adolphson, LLP

(57) ABSTRACT

A coating composition is applied to a print stock substrate for preparing a thermally-active layer, the coating composition comprising: a developer comprising at least one or a combination of 6'-dipentylamino-3'-methyl-2'(phenylamino)-spiro [isobenzofuran-1(3H),9'-[9H]xanthen]-3-one (CAS No. 129473-78-5) and 6'-dibutylamino-3'-methyl-2'(phenylamino)-spiro [isobenzofuran-1(3H),9'-[9H]xanthen]-3-one (CAS No. 89331-94-2); a sensitizer comprising at least one or a combination of 1,1'-sulfonylbisbenzene (CAS No. 127-63-9) and dimethylterephthalate (CAS No. 120-61-6); and a coreactant (or developer) comprising at least one or a combination of bis(4-hydroxyphenyl)-4-methylpentane (CAS No. 6807-17-6) and 4-hydroxy-4'-isopropoxydiphenylsulfone (CAS No. 95235-30-6). Preferably, the print stock substrate will be coated with clay or the like to provide a smooth coating surface for the thermally-active layer. Also preferably, the thermally-active layer will be overcoated with a protective layer.

8 Claims, 2 Drawing Sheets

0° rotated

90° rotated

0° rotated

THERMAL PRINT PAPER AND PROCESS

This application claims the benefit of provisional application Ser. No. 60/268,425, filed Feb. 13, 2001.

BACKGROUND OF THE INVENTION

The invention concerns a new coating for paper and other substrates for use in direct thermal printing.

Thermal printers selectively heat a heat-sensitive coating to print on a suitable substrate stock such as paper or paperboard. They can be used for a wide variety of purposes, most of which call for sharp contrast between white and dark areas and uniform density of the dark areas even with varying energy inputs.

Direct thermal print media typically comprise three layers coated on paper or other substrate: a first coating, in contact with the substrate of clay and a binder; a second, active layer comprising the thermally sensitive components; and, a top coat of a material suitable to protect the active layer before and after image formation. The active layer typically comprises a dye, a sensitizer and a color developer (also sometimes referred to as a coreactant).

A number of prior patents list various combinations of active layer ingredients.

In U.S. Pat. No. 5,066,634, Minami, et al., describe heat-sensitive recording materials which are said to have superior heat, water and oil resistance. To achieve this they employ a specific developer of 4-hydroxy-4'-n-propoxydiphenylsulfone and at least one fluorane-leuco dye from a specific class. The data show comparable image densities for the invention and the comparisons, with differences in the noted properties of heat, water and oil resistance in the absence of an overcoating layer.

In U.S. Pat. No. 5,116,802, Arai, et al., describe a heat sensitive recording material which, in the absence of an overcoating layer, will avoid deposits on the thermal print head. They disclose the combination of di(p-methylbenzyl) oxalate with a basic dye comprising 3-di(n-butyl)amino-6-methyl-7-phenylaminofluoran and a developer such as 4-hydroxy-4'-isopropoxydiphenylsulfone or 4,4'-isopropylidenediphenol.

There is a need for thermally sensitive recording media having high contrast when printed and comprising an overcoating designed for long life of the printed image.

SUMMARY OF THE INVENTION

The invention provides both a new print stock specially adapted for use in thermal printing and to a composition and a method for making it.

A coating composition is applied to a print stock substrate for preparing a thermally-active layer, the coating composition comprising:

- a dye comprising at least one or a combination of 6'-dipentylamino-3'-methyl-2'(phenylamino)-spiro [isobenzofuran-1(3H),9'-[9H]xanthen]-3-one (CAS No. 129473-78-5) and 6'-dibutylamino-3'-methyl-2' (phenylamino)-spiro [isobenzofuran-1(3H),9'-[9H] xanthen]-3-one (CAS No. 89331-94-2);
- a sensitizer comprising at least one or a combination of 1,1'-sulfonylbisbenzene (CAS No. 127-63-9) and dimethylterephthalate (CAS No. 120-61-6); and
- a coreactant (or developer) comprising at least one or a combination of bis(4-hydroxyphenyl)-4-methylpentane (CAS No. 6807-17-6) and 4-hydroxy-4'-isopropoxydiphenylsulfone (CAS No. 95235-30-6).

Also preferably-the thermally-active layer will be overcoated with a protective layer.

The method of the invention comprises preparing the above composition and applying it to a print stock substrate. The product of this process is also new.

Many of the preferred aspects of the invention are described below.

BRIEF DESCRIPTION OF THE DRAWINGS

The invention will become more apparent from the following description, especially when taken in light of the examples and the accompanying drawings, wherein.

DESCRIPTION OF THE INVENTION

Figure 1:
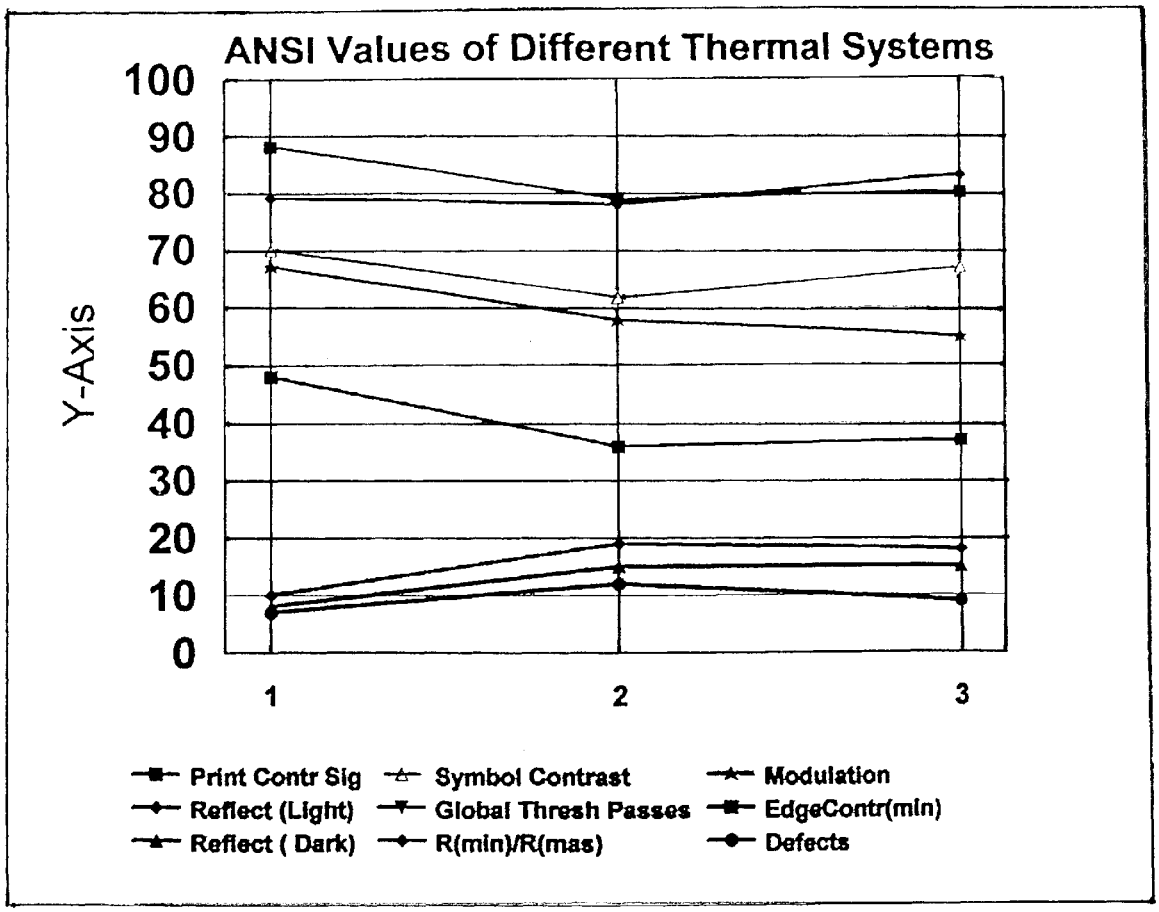
FIGS. 1 and 2 graphically represent the results of tests set forth in the Examples below.

The invention provides a coating composition, coated substrates and a method for coating substrates all for the purpose of providing improved thermal printing. The invention will be described with particular attention to coated paper useful for thermal printers, and it will be understood that any print stock substrate that can be fed into a thermal printer can be employed as the substrate for a thermal print medium according to the invention, e.g., paper, paperboard, polymeric film, synthetic paper, nonwoven foils and textiles.

The coating compositions of the invention comprise aqueous mixtures of the noted dyes, sensitizers and developers in proportions suitable for coating. Typically, and preferably, each of these three types of materials is prepared as a separate dispersion and the three are then mixed. In addition to these essential materials, the coating composition will also preferably contain a binding polymer such as polyvinyl alcohol or the like.

As noted above, the compositions will all contain as a developer (or coreactant), at least one or a combination of bis(4-hydroxyphenyl)-4-methylpentane (BHPMP) (CAS No. 6807-17-6) and 4-hydroxy-4'-isopropoxydiphenylsulfone (D-8) (CAS No. 95235-30-6)., which is effective in a weight ratio relative to the dye of from about 4:1 to about 1:1, e.g., from about 3:1 to about 3:2. Typically, the ratio will be close to 2:1. Similar ratios will be employed for the amounts of sensitizer to dye. One commercial form of the developer bis(4-hydroxyphenyl)-4-methylpentane is BHPMP, available from Specialty Chem Products. The developer is preferably prepared as an aqueous dispersion with water and a binder such as polyvinyl alcohol. The concentration of the dispersion will be about 20 to 50% solids, with the developer comprising from about 20 to about 45% of the dispersion weight. Typical concentrations will be from about 30 to about 38% developer. Following mixing, the dispersion is milled until the average particle size is suitable for fine coating, typically from 0.2 to 2.0 micrometers, e.g., less than 0.55 micrometers.

Similar dispersions are preferably prepared for the dye and the sensitizer. As noted above, the dye comprises at least one or a combination of 6'-dipentylamino-3'-methyl-2' (phenylamino)-spiro [isobenzofuran-1(3H),9'-[9H] xanthen]-3-one (CAS No. 129473-78-5), available from Sofix as BK 305, and 6'-dibutylamino-3'-methyl-2' (phenylamino)-spiro [isobenzofuran-1(3H),9'-[9H] xanthen]-3-one (CAS No. 89331-94-2) available from Sofix as BK 400. It is an advantage of the invention that the materials can be used alone or in combination as the dye component. Combinations can be in any reasonable proportions.

The sensitizer 1,1'-sulfonylbisbenzene (CAS No. 127-63-9) (DPS) is available commercially as DPS from Sloss Industries. The sensitizer dimethylterephthalate (CAS No. 120-61-6) is commercially available as DMT.

The coating composition will also preferably employ conventional materials such as: optical brighteners, e.g., Leucophor from Clairiant; dispersing agents, e.g., Tamol 731 from Rohm & Haas; defoamers, e.g., Surfynol 104 from Air Products; Kaolin, e.g., Ultrawhite 90 from Engelhard; calcium carbonate, e.g., Hydrocarb 90 from Omya; cross linking agents, e.g., Resimene AQ7550 from Solutia; antioxidants, e.g., DH43 from Nagase; and the like. These materials will be used in amounts effective for their intended purposes.

The above coating composition is applied to a suitable thermal media stock and dried in conventional manner. For example, airknife, rod, Maier rod, blade and flexographic coaters can be used.

Also preferably, the thermally-active layer will be overcoated with a protective layer suitable for the particular application.

The following Examples are provided to further illustrate and explain a preferred form of the invention and are not to be taken as limiting in any regard. Unless otherwise indicated, all parts and percentages are by weight.

EXAMPLE 1

This example describes the preparation of a coated paper according to a preferred process of the invention.

The following three dispersion compositions are prepared utilizing the noted ingredients and deionized water according to the following procedure to form the coating:

Compostion A

| Ingredient (Grade, Supplier) | Parts by Weight |
|---|---|
| Dye (Black 305, Sofix) | 85 |
| Polyvinyl Alcohol (Airvol 502, Air Products) | 15 |
| Water | 177 |

Compostion B

| Ingredient (Grade, Supplier) | Parts by Weight |
|---|---|
| Sensitizer (DPS, Schloss) | 85 |
| Polyvinyl Alcohol (Airvol 502, Air Products) | 15 |
| Water | 177 |

Compostion C

| Ingredient (Grade, Supplier) | Parts by Weight |
|---|---|
| Developer (BHPMP, Specialty Chem) | 85 |
| Polyvinyl Alcohol (Airvol 502, Air Products) | 15 |
| Water | 177 |

Each of these compositions was pulverized in a horizontal small media mill until the average particle size was less than 0.55 micrometers.

A coating composition is then prepared by blending 11 parts of Composition A, 21 parts of Composition B and 21 parts of Composition C, with 20 parts of an aqueous solution of polyvinyl alcohol 4 parts of a white small particle size kaolin clay, 1 part of a melamine formaldehyyde resin and an additional 23 parts of water, with stirring.

A line of this mixture is poured across a sheet of clay-coated paper (e.g., 74 grams per square meter white paper) and a No. 12 wire-wound round rod is drawn across the paper to spread the mixture evenly across the surface of the paper. After drying with a hair dryer, the resulting coating has a weight of about 6 grams per square meter.

EXAMPLE 2

Paper as prepared in Example 1 was tested with papers prepared in like manner but substituting D8 for BHPMP.

EXAMPLE 3

Paper as prepared in Example 1 was tested with papers prepared in like manner but substituting PMB-2 (1,2-bis (phenoxy methyl)benzene—CAS No. 10403-74-4) for DPS.

Figure 2:
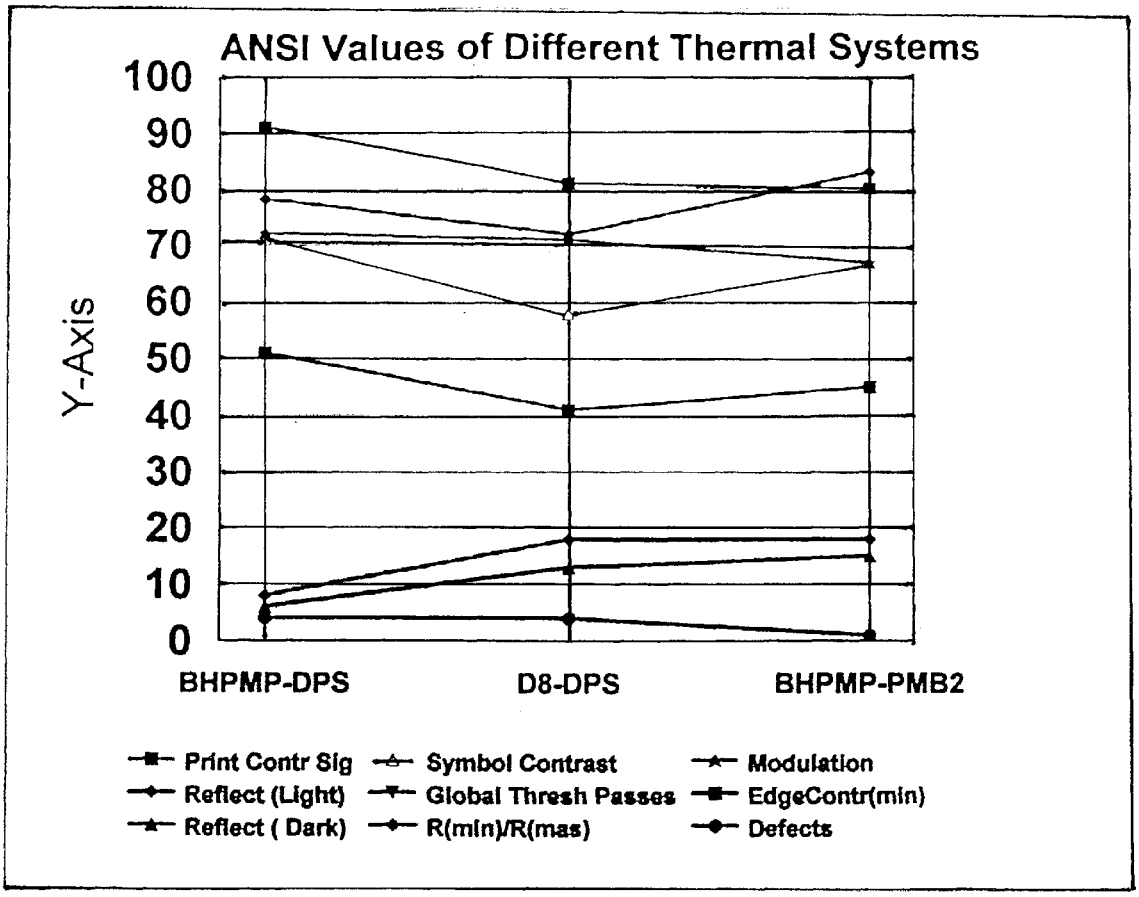

The thermal response of the thermally active sheets were tested with an Atlantek Model 3000 Thermal Response Test System. In this system, the pulse length is varied to give different amounts of energy to different sections of the paper. The Atlantek instrument was used to print bar codes. The bar codes were read with a PSC Quick Check 500 verifier, Photographic Sciences Corp. The bar codes were evaluated according to the ANSI system. The results are given in Tables 1 and 2 and in FIGS. 1 and 2.

When interpreting this data, it will be noted that the top four parameters are better if higher and the bottom four show better results with lower numbers.

TABLE 2

(Corresponding To FIG. 1)
90 Degree Rotated Bar Code Sensitivity

| | Relative Sensitivity | | |
|---|---|---|---|
| | BHPMP-DPS | D8-DPS | BHPMP-PMB2 |
| Print Contrast Signal | 88 | 79 | 83 |
| Reflect (light) | 79 | 78 | 88 |
| Reflect (dark) | 8 | 15 | 14 |
| Symbol Contrast | 70 | 62 | 73 |
| R(min)/R(max) | 10 | 19 | 16 |
| Modulation | 67 | 58 | 66 |
| Edge Contrast | 48 | 36 | 49 |
| Defects | 7 | 12 | 8 |

TABLE 3

(Corresponding To FIG. 2)
0 Degree Rotated Bar Code Sensitivity

| | Relative Sensitivity | | |
|---|---|---|---|
| | BHPMP-DPS | D8-DPS | BHPMP-PMB2 |
| Print Contrast Signal | 91 | 81 | 82 |
| Reflect (light) | 78 | 72 | 83 |
| Reflect (dark) | 6 | 13 | 14 |
| Symbol Contrast | 71 | 58 | 69 |
| R(min)/R(max) | 8 | 18 | 16 |
| Modulation | 72 | 71 | 78 |
| Edge Contrast | 51 | 41 | 54 |
| Defects | 4 | 4 | 7 |

As can be seen from the results in the tables, the heat sensitive recording material of the invention is excellent in imaging both solid areas and bar codes. The accompanying Figures, depict the results graphically.

The above description is intended to enable the person skilled in the art to practice the invention. It is not intended to detail all of the possible modifications and variations which will become apparent to the skilled worker upon reading the description. It is intended, however, that all such modifications and variations be included within the scope of the invention which is seen in the above description and otherwise defined by the following claims. The claims are meant to cover the indicated elements and steps in any arrangement or sequence which is effective to meet the objectives intended for the invention, unless the context specifically indicates the contrary.

What is claimed is:

1. A coating composition for application to a print stock substrate for preparing a thermally-active layer, the coating composition comprising:

a dye comprising at least one or a combination of 6'-dipentylamino-3'-methyl-2'(phenylamino)-spiro [isobenzofuran-1(3H),9'-[9H]xanthen]-3-one (CAS No. 129473-78-5) and 6'-dibutylamino-3'-methyl-2'(phenylamino)-spiro [isobenzofuran-1(3H),9'-[9H]xanthen]-3-one (CAS No. 89331-94-2);

a sensitizer comprising at least one or a combination of 1,1'-sulfonylbisbenzene (CAS No. 127-63-9) and dimethylterephthalate (CAS No. 120-61-6); and a coreactant (or developer) comprising at least one or a combination of bis(4-hydroxyphenyl)-4-methylpentane (CAS No. 6807-17-6) and 4-hydroxy-4'-isopropoxydiphenylsulfone (CAS No. 95235-30-6).

2. A coating composition according to claim 1 wherein the dye comprises a mixture of 6'-dipentylamino-3'-methyl-2'(phenylamino)-spiro [isobenzofuran-1 (3H),9'-[9H]xanthen]-3-one (CAS No. 129473-78-5) and 6'-dibutylamino-3'-methyl-2'(phenylamino)-spiro [isobenzofuran-1(3H),9'-[9H]xanthen]-3-one (CAS No. 89331-94-2).

3. A coating composition according to claim 1 wherein the dye comprises 6'-dipentylamino-3'-methyl-2'(phenylamino)-spiro [isobenzofuran-1(3H),9'-[9H]xanthen]-3-one (CAS No. 129473-78-5).

4. A coating composition according to claim 1 wherein the dye comprises 6'-dibutylamino-3'-methyl-2'(phenylamino)-spiro [isobenzofuran-1(3H), 9'-[9H]xanthen]-3-one (CAS No. 89331-94-2).

5. A coated print stock substrate comprising: a substrate and a dried coating prepared from the composition of any of claims 1–4.

6. A coated print stock substrate according to claim 5 wherein the substrate is a member selected from the group consisting of paper, paperboard, polymeric film, synthetic paper, nonwoven foils and batts, and textiles.

7. A method for making thermal printing print stock, comprising:

applying a uniform layer of the composition of any of claims 1–4 to a suitable print stock substrate.

8. A printed image prepared from the thermal printing print stock of claim 7.

* * * * *